US011629314B2

(12) United States Patent
Bucio et al.

(10) Patent No.: US 11,629,314 B2
(45) Date of Patent: Apr. 18, 2023

(54) HOME CARE COMPOSITIONS

(71) Applicant: Colgate-Palmolive Company, New York, NY (US)

(72) Inventors: Jose Bucio, Guanajuato (MX); Raul Arellano Maldonado, Mexico City (MX); Andrea Sanchez, Col. Granada (MX)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 17/250,877

(22) PCT Filed: Sep. 19, 2019

(86) PCT No.: PCT/US2019/051824
§ 371 (c)(1),
(2) Date: Mar. 18, 2021

(87) PCT Pub. No.: WO2020/061248
PCT Pub. Date: Mar. 26, 2020

(65) Prior Publication Data

US 2022/0049192 A1 Feb. 17, 2022

Related U.S. Application Data

(60) Provisional application No. 62/733,944, filed on Sep. 20, 2018.

(51) Int. Cl.
*C11D 3/37* (2006.01)
*C11D 3/20* (2006.01)
(Continued)

(52) U.S. Cl.
CPC ..... *C11D 3/3742* (2013.01); *C11D 1/72* (2013.01); *C11D 3/0015* (2013.01);
(Continued)

(58) Field of Classification Search
CPC combination set(s) only.
See application file for complete search history.

(56) References Cited

U.S. PATENT DOCUMENTS 4,800,026 A * 1/1989 Coffindaffer ..... D06M 15/6436 510/516
4,891,166 A 1/1990 Krakenberg et al.
(Continued)

FOREIGN PATENT DOCUMENTS

EP 3299445 3/2018
EP 3299445 A1 * 3/2018 ..... C11D 1/83
(Continued)

OTHER PUBLICATIONS

Deng, Shunyang, 2001, "Textile Chemicals," China Petrochemical Press, p. 230.
(Continued)

*Primary Examiner* — Nicole M. Buie-Hatcher
*Assistant Examiner* — M. Reza Asdjodi

(57) ABSTRACT

Described herein, are fabric care compositions comprising: an aminofunctional polysiloxance; optionally a thickening agent; and optionally a non-ionic surfactant. Methods of making and using these compositions are also described.

18 Claims, 10 Drawing Sheets

(51) Int. Cl.

| | |
|---|---|
| ***C11D 1/72*** | (2006.01) |
| ***C11D 3/00*** | (2006.01) |
| ***C11D 3/30*** | (2006.01) |
| ***C11D 11/00*** | (2006.01) |

(52) U.S. Cl.
CPC ..... *C11D 3/0036* (2013.01); *C11D 3/2086* (2013.01); *C11D 3/30* (2013.01); *C11D 3/3765* (2013.01); *C11D 11/0017* (2013.01)

(56) References Cited

U.S. PATENT DOCUMENTS 6,376,456 B1* 4/2002 Murphy ..... C11D 3/3742 510/516
6,734,153 B2 5/2004 Scheper
7,273,837 B2 9/2007 Boutique et al.
9,506,019 B2 11/2016 Vetter et al.
9,732,306 B2 8/2017 Gonzalez de Cossio et al.
2005/0170994 A1* 8/2005 Casado-Dominguez ..... D06M 13/005 510/499
2008/0171684 A1* 7/2008 Boutique ..... C11D 3/373 510/343
2011/0190190 A1* 8/2011 Schubert ..... C08L 83/12 510/330
2012/0004156 A1* 1/2012 Panandiker ..... C11D 1/008 510/516
2012/0077725 A1* 3/2012 Wang ..... D06M 15/647 510/528
2015/0147286 A1* 5/2015 Barrera ..... A61Q 5/12 424/70.122
2015/0197708 A1* 7/2015 Jin ..... C11D 3/3796 510/515
2015/0337239 A1* 11/2015 Gonzalez de Cossio ..... C11D 3/0026 556/413
2016/0215238 A1* 7/2016 Vetter ..... C11D 3/042
2016/0281034 A1* 9/2016 Panandiker ..... C11D 3/3742
2017/0211019 A1* 7/2017 Sivik ..... C11D 3/373
2019/0002798 A1* 1/2019 Valdepena ..... C11D 1/72
2020/0224124 A1* 7/2020 Bautista Cid ..... C11D 3/30
2020/0299616 A1* 9/2020 Trambitas ..... C11D 3/0015
2020/0385652 A1* 12/2020 Valdepena ..... C11D 17/0017
2021/0253978 A1* 8/2021 Panandiker ..... C11D 3/0015
2022/0049192 A1* 2/2022 Bucio ..... C11D 11/0017

FOREIGN PATENT DOCUMENTS

WO 2000/024853 5/2000
WO 2017/116397 7/2017

OTHER PUBLICATIONS

Dong, Yongchun, 2007, "Chemistry and Application of Textile Auxiliaries," China Textile & Apparel Press pp. 113-114.
International Search Report and the Written Opinion of the International Searching Authority issued in International Application PCT/US2019/051824 dated Nov. 22, 2019.
Wacker, 2015, "Wacker HC 303" Safety Data Sheet.
Jianzhong et al., "Leather Chemicals," Chemical Industry Press, Feb. 2008, pp. 352-353.

* cited by examiner

HOME CARE COMPOSITIONS

BACKGROUND

Current liquid fabric softeners often include an esterquat as the principal active ingredient to provide softness and fragrance. In addition to fabric softening benefits, commercially available products generally claim to provide additional benefits, e.g. ease of ironing, wrinkle reduction, fast dry, etc. One benefit which has proven to be somewhat elusive, however, is stain resistance/prevention.

Another issue with currently available products is that the number of benefits tends to be determined by the number of additives; with multiple compositions often being required to deliver a multitude of benefits. For a variety of reasons, including simplicity of use and cost, it is highly desirable to have a product that provides all of the aforementioned benefits in a single composition. Embodiments of the present invention are designed to meet these needs.

BRIEF SUMMARY

In some embodiments, the present invention provides a fabric care composition comprising: an aminofunctional polysiloxane; an acrylate thickening agent; and a non-ionic surfactant; wherein the aminofunctional polysiloxane is present in an amount effective to resist or prevent a stain.

In other embodiments, the present invention provides a method for resisting, preventing or removing a stain on a fabric comprising: contacting the fabric with a fabric care composition as described herein.

Still further embodiments provide methods for resisting, preventing or removing a stain on a fabric comprising: contacting the fabric with any one of the fabric care compositions described herein.

Other embodiments provide methods for maintaining a fabric, comprising contacting a fabric, previously washed with a detergent, with any one of the compositions described herein.

DETAILED DESCRIPTION

Figure 1:
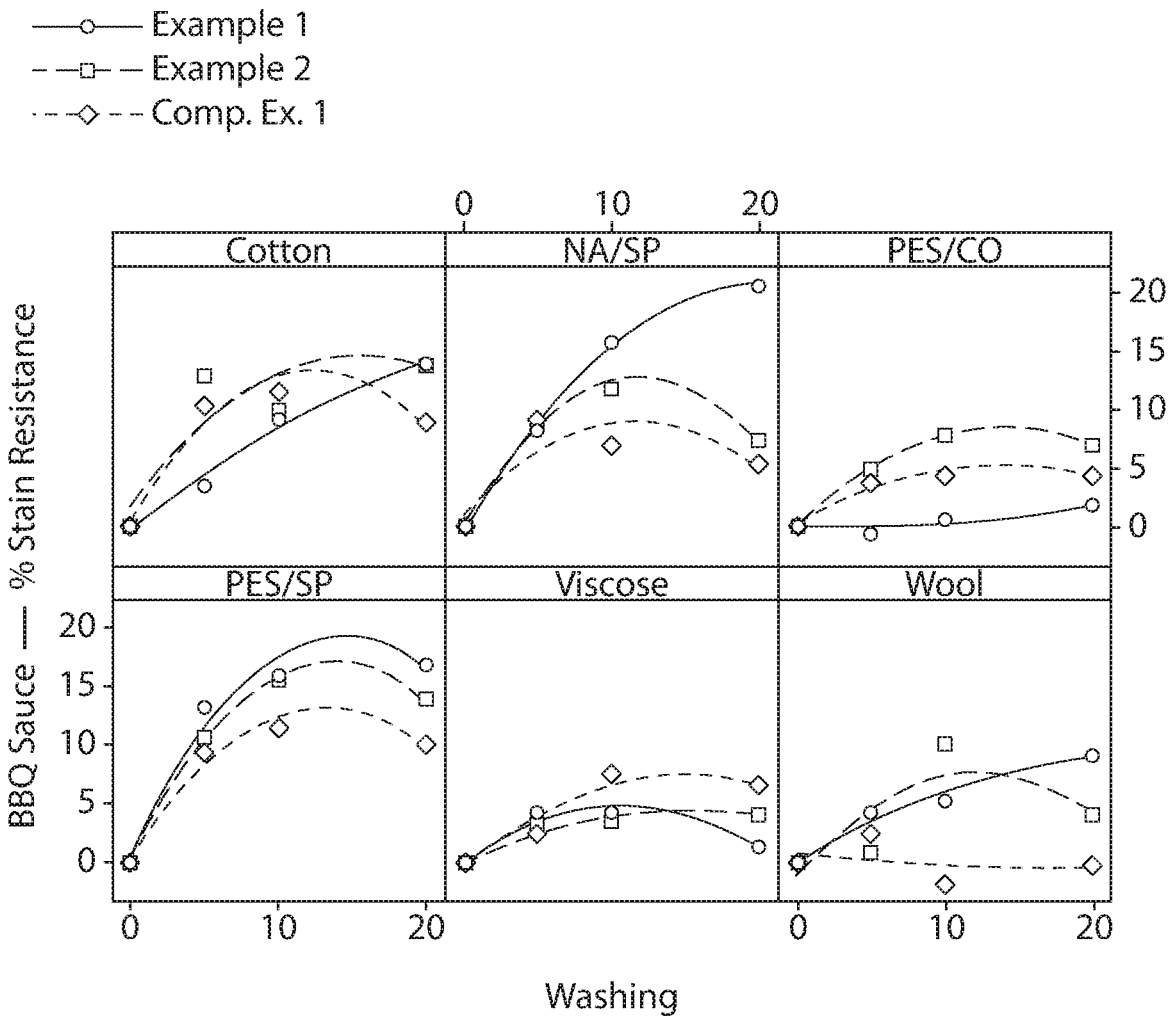
FIG. 1 depicts data generated from exemplary compositions of the present invention, along with various comparative compositions. The data describes—inter alia—the reduction of barbeque sauce stain adherence to various fabrics.

In some embodiments, the present invention provides a fabric care composition comprising an aminofunctional polysiloxane; a thickening agent; and a non-ionic surfactant; wherein the aminofunctional polysiloxane is present in an amount effective to resist or prevent a stain. In other embodiments, the present invention provides a fabric care composition comprising a stain fighting agent; a thickening agent; and a non-ionic surfactant.

In some embodiments, the stain fighting agent comprises an aminofunctional silicone. In other embodiments, the stain fighting agent comprises an aminofunctional polysiloxane. In still further embodiments, the stain fighting agent is provided in the form of an emulsion.

Some embodiments of the present invention provide fabric care compositions, wherein the aminofunctional polysiloxane is present in an amount of from about 0.1% to about 1%, by weight of the fabric care composition. Further embodiments of the present invention provide fabric care compositions wherein the aminofunctional polysiloxane is present in an amount of from about 0.2% to about 0.75%, by weight of the fabric care composition. Still further embodiments of the present invention provide fabric care compositions wherein the aminofunctional polysiloxane is present in an amount of from about 0.25% to about 0.5%, by weight of the fabric care composition. Yet other embodiments provide fabric care compositions wherein the aminofunctional polysiloxane is present in an amount of about 0.05%, 0.1%, 0.15%, 0.2%, 0.25%, 0.3%, 0.35%, 0.4%, 0.45% or 0.5%, by weight of the fabric care composition.

In some embodiments, the aminofunctional polysiloxane comprises a compound of Formula (I):

(I)

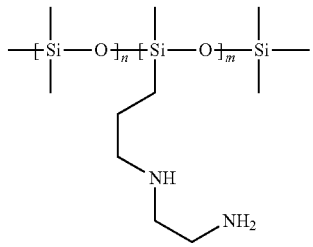

In some embodiments, the present invention provides fabric care compositions further comprising a co-softening agent.

In some embodiments, the fabric care composition further comprises a non-ionic surfactant in an amount of from about 0.1% to about 0.5%, by weight of the fabric care composition. In other embodiments, the fabric care composition comprises a non-ionic surfactant in an amount of from about 0.15% to about 0.275%, by weight of the fabric care composition. Still further embodiments provide fabric care compositions comprising a non-ionic surfactant in an amount of from about 0.2% to about 0.25%, by weight of the fabric care composition. Yet other embodiments provide fabric care compositions comprising a non-ionic surfactant in an amount of about 0.24%, by weight of the fabric care composition.

In some embodiments, the non-ionic surfactant comprises an alkoxylated alcohol. In some embodiments, the alkoxylated alcohol is preferably an ethoxylated $C_6$-$C_{22}$ fatty alcohol having a linear or branched alkyl chain and having an average ethoxylation degree between 1-50, preferably between 1-30, more preferably between 1-15; or an ethoxylated linear or branched $C_7$-$C_{15}$ secondary alcohol, preferably ethoxylated linear $C_{11}$-$C_{15}$ alcohol having an average ethoxylation degree between 1-20, preferably between 5-15, more preferably 10-15, even more preferably 14-15.

In order to adjust the viscosity, the fabric care composition may include one or more thickeners. However, the one or more thickeners may also need to support the clear or translucent nature of the fabric care composition. The one or more thickeners may include associative thickeners that are water soluble and with a high molecular weight, including, for example, a molecular weight of between 200 g/mol and 10,000 g/mol. For example, the thickener can be a polyoxyethylene sorbitol tetra stearate thickener, commercially available as ALKONT EL 3645 from Oxiteno, S.A., São Paulo, Brazil. In other embodiments, the thickener may be an acrylate copolymer designed for high clarity, such as a polyacrylate-1 crosspolymer, commercially available as CARBOPOL AQUA CC POLYMER from Lubrizol Corporation, Wickliffe, Ohio. Other suitable thickeners include Polysorbate triesters, PEG-9 Cocoate, PEG-32 Distearate, and PEG-175 Distearate. In some embodiments, the thickeners have a hydrophilic-lipophilic balance (HLB) value of 10 or greater.

In certain embodiments, the fabric care composition includes no more than 5 weight % thickening agent, based on the total weight of the fabric care composition. In certain embodiments, the fabric care composition includes between 4 weight % and 0.05 weight % thickening agent, based on the total weight of the fabric care composition. In certain embodiments, the fabric care composition includes between 3 weight % and 0.1% weight %, between 2 weight % and 0.2 weight %, or between 2 weight % and 0.25 weight % thickening agent, or about 0.3 weight % thickening agent. As used herein, the terms "thickener" and "thickening agent" may be used interchangeably.

In some embodiments, the thickening agent comprises an acrylate thickening agent. In other embodiments, the thickening agent is cationic. Still other embodiments provide fabric care compositions wherein the thickening agent is provided in the form of an emulsion.

In some embodiments, the fabric care composition must be easily pourable by an end user. Accordingly, the viscosity of the fabric care composition should not exceed 500 centipois (cP) for ready-to-use fabric care compositions, preferably not more than 250 cPs, and 10,000 cPs for fabric care composition intended for dilution before use. In certain embodiments, the fabric care composition has a pour viscosity from 30 to 500 cPs, or from 50 to 200 cPs. Unless otherwise specified, viscosity is measured at 25° C. using a Brookfield RVTD Digital Viscometer with Spindle #2 at 50 rpm.

In some embodiments, the fabric care composition further comprises a pH modifying agent. In other embodiments, the pH modifying agent is present in an amount from about 0.01% to about 0.1%, by weight of the fabric care composition. Still further embodiments provide fabric care compositions wherein the pH modifying agent is present in an amount from about 0.02% to about 0.08%, by weight of the fabric care composition. While other embodiments provide fabric care compositions wherein the pH modifying agent is present in an amount from about 0.025% to about 0.075%, by weight of the fabric care composition. Yet other embodiments provide fabric care compositions wherein the pH modifying agent is present in an amount from about 0.05% to about 0.07%, by weight of the fabric care composition. In some embodiments, the fabric care composition comprises a pH modifying agent in an amount of about 0.0625, by weight of the fabric care composition.

In further embodiments, the pH modifying agent comprises citric acid, lactic acid, or a combination thereof. In some embodiments, the pH modifying agent is present in an amount effective to maintain the pH of the fabric care composition in a range of from about 2.5 to about 4.

In some embodiments, the stain is selected from: an oil stain; a mustard stain; a barbeque sauce stain; a chocolate milk stain; and a coffee stain.

In some embodiments, the fabric care composition further comprises a defoaming agent. In some embodiments, the defoaming, agent comprises a silicone.

Certain embodiments provide a method for resisting, preventing or removing a stain on a fabric comprising: contacting the fabric with any one of the fabric care compositions described herein. In some embodiments, the present invention provides methods of resisting, preventing or removing a stain selected from: an oil stain; a mustard stain; a barbeque sauce stain; a chocolate milk stain; and a coffee stain.

Still further embodiments provide a method for rinsing fabrics comprising contacting a fabric, previously washed in a detergent liquor, with any one of the compositions described herein. In some embodiments, the rinse process may be performed manually in basin or bucket, in a non-automated washing machine, or in an automated washing machine. When hand washing is performed, the laundered fabrics are removed from the detergent liquor and wrung out. In some embodiments, the fabric care composition of the present invention is then added to fresh water and the fabrics are then, directly or after an optional inefficient first rinse step, rinsed in the water containing the composition according to the conventional rinsing habit. The fabrics are then dried using conventional means.

Some embodiments provide a method for reducing the volume of water consumed in a laundering operation.

In some embodiments, the terms "fabric conditioning composition", "in-wash fabric conditioning composition", "rinse-fee composition", "laundry composition" and the like, are used interchangeably.

In other embodiments, the fabric care composition comprises from about 75 to about 95 wt % water. In other embodiments, the fabric care composition comprises from about 80 to about 95 wt % water. In other embodiments, the fabric care composition comprises from about 85 to about 95 wt % water. In other embodiments, the fabric care composition comprises from about 90 to about 95 wt % water.

In some embodiments, the fabric care composition further comprises a chelating agent. In some embodiments, the fabric care composition further comprises from about 0.01 to about 0.5 wt % of a chelating agent, based upon the total weight of the composition. In some embodiments, the chelating agent comprises phosphonic acid. In some embodiments, the chelating agent may be amino tris methylene phosphonic acid.

In some embodiments, the fabric care composition further comprises a fragrance. In some embodiments, the fragrance comprises a combination of an organic fragrance oil and a slurry of capsules containing an organic fragrance oil. If present, the fragrance composition may be included in a ratio of 0.5:1, 1:0.5, 1:1, 2:0.5, 0.5:2, 1:3, or 3:1, based upon total weight of the fabric care composition. Such fragrance capsules may be formed of a friable wall that releases an oil fragrance when broken by the agitation forces (e.g., rubbing, pressing) of the washing cycle, once the aqueous solvent media is eliminated. Examples of commercially available fragrance capsules that may be utilized with the fabric conditioning composition of the invention include those supplied by Firmenich Inc. (Plainsboro, NR), International Flavors and Fragrances Inc. (New York, N.Y.), and Givaudan (Vernier, Switzerland).

In some embodiments, the compositions of the present invention further comprise a preservative. In some embodiments, the preservative comprises a mixture of isothiazolone compounds. In some embodiments, the preservative is present in an amount effective to increase the fabric conditioning composition's stability against microorganisms.

In some embodiments, the present invention provides a fabric care composition further comprising a co-softener. In some embodiments, the co-softener is a cationic co-softener. In certain embodiments, the co-softener is present in an amount of from about 0.1% to about 0.5%, by weight of the fabric care composition. In yet other embodiments, the co-softener is present in an amount of about 0.3%, by weight of the fabric care composition. In some embodiments, the co-softener is present in an amount of about 0.33%, by weight of the fabric care composition.

In some embodiments, the fabric care composition is clear or translucent. As used herein, the term "clear" is defined as transparent, preferably as in "water clear," when observed through a layer having a thickness of less than about 10 cm. As used herein "translucent" is defined as allowing light to pass through but not clearly or semi-transparent. In other embodiments, clarity or translucence is determined via turbidity measurements. For example, fabric care compositions with a clarity value below about 70 nephelometric turbidity units (NTU), preferably below 60 NTU, may be considered "clear," while fabric care composition with a clarity value below 50 NTU, preferably below 50 NTU are considered "translucent." Turbidity may be measured using a HACH 2100Q portable Turbidimeter. In one embodiment, the fabric care composition has a turbidity value of 70 NTU or less. In other embodiments, the fabric care composition has a turbidity value of 60 NTU or less, 50 NTU or less, 40 NTU or less, or 30 NTU or less. In one embodiment, the fabric care composition has a turbidity value between 30 and 50 NTU.

In some embodiments, the fabric care compositions of the present invention further comprise a fabric softening agent, e.g. a fatty alcohol, glycerol mono-stearate or glycerol mono-oleate. The fabric softening agent may be a polyquatemium polymer. According to one embodiment, the fabric softening agent is a stable, water-soluble, and liquid polyquaternium polymer. For example, the fabric softening agent may be polyquaternium-7. Polyquaternium-7 (197) is the copolymer of acrylamide and diallyldimethylammonium chloride, and is usually represented with the following chemical formula: $(C_8H_{16}ClN)_n(C_3H_5NO)_m$. Polyquatemium-7 is available commercially as NOVERITE 300 from Lubrizol Corporation, Wickliffe, Ohio, or as Flocare LS737 from SNF Floerger, Andrézieux, France.

Other optional components commonly used in fabric care compositions may be added in minor amounts to enhance either the appearance or performance properties of the liquid fabric softener compositions of this invention.

In some embodiments, the compositions of the preset invention further comprise a colorant. In some embodiments, the colorant is water-soluble, for example, those commercialized by Milliken & Company (Spartanburg, S.C.) under the brand name Liquitint®.

In some embodiments, the fabric care compositions of the present invention further comprise a wax. In some embodiments, the wax is a synthetic wax.

In some embodiments, the inventive compositions of the present invention comprise a matrix which sequesters the cationic ingredients of the composition. In some embodiments, the matrix is adapted to permit the cationic ingredients to provide their function, while minimizing—or preferably avoiding—any interaction with anionic ingredients, e.g. detergents or surfactants.

In some embodiments, the fabric care compositions of the present invention may be prepared as a liquid composition. In some embodiments, the fabric care compositions of the present invention are single-phase compositions. In other embodiments, the fabric care compositions of the present invention provide wrinkle reduction, anti-pilling, ease of ironing, fast dry, and stain resistance/prevention benefits from a single composition.

Embodiments of the present invention will now be further described by way of the following, non-limiting, examples.

EXAMPLES

Example 1

Four (4) exemplary fabric care compositions (Ex. 1 to Ex. 4) and two (2) comparative fabric care compositions (Comp. Ex. 1 and Comp. Ex. 2) are prepared in accordance with the formulas set forth in Table 1 (below).

TABLE 1

| Ingredient | Ex. 1 | Ex. 2 | Ex. 3 | Ex. 4 | Comp. Ex. 1 | Comp. Ex. 2 |
|---|---|---|---|---|---|---|
| Water | 94.5566 | 94.5066 | 94.3866 | 94.3066 | 94.7856 | 94-96 |
| C14-C15 Alcohol EO 20:1 | 0.24 | 0.24 | 0.24 | 0.24 | — | 0.24 |
| Lactic Acid | 0.0625 | 0.0625 | 0.0625 | 0.0625 | 0.0625 | 0.0625 |
| Acrylate thickener | 0.3 | 0.3 | 0.3 | 0.3 | 0.3035 | 0.3 |
| Esterquat | 3.2787 | 3.2787 | 3.2787 | 3.2787 | 3.4973 | 3-4 |
| Microbicide | 0.020 | 0.020 | 0.020 | 0.020 | 0.020 | 0.020 |

TABLE 1-continued

| Ingredient | Ex. 1 | Ex. 2 | Ex. 3 | Ex. 4 | Comp. Ex. 1 | Comp. Ex. 2 |
|---|---|---|---|---|---|---|
| Silicone antifoam 1086 | 0.08 | 0.08 | 0.08 | 0.08 | — | 0.08 |
| Polyquaternium-7 | 0.33 | 0.33 | 0.33 | 0.33 | 0.4889 | 0.33 |
| Aminofunctional polysiloxane | 0.25 | 0.3 | 0.4 | 0.5 | — | — |
| Mercaptoalkylsiloxane alkylaminomethacrylate copolymer | — | — | — | — | — | 0-0.5 (e.g. 0.15) |
| Colorant(s), fragrance(s), etc. | QS | QS | QS | QS | QS | QS |
| Total | 100 | 100 | 100 | 100 | 100 | 100 |

The compositions described in Table 1 (above) may be prepared using conventional means known to those skilled in the art.

Example 2

Six fabrics—bleached cotton cloth (100%); polyester/cotton 65/35 shirts with durable press finish; spun viscose challis; nylon/lycra swimwear; worsted wool challis; and polyester/lycra—are treated five (5), ten (10), fifteen (15) and twenty (20) times in a full laundry cycle applying the conditions described in Table 2, with a comparative fabric softener, an exemplary composition and a commercial detergent, respectively. After drying, each fabric was stained with chocolate, coffee, kitchen oil, barbeque sauce and mustard then cleaned with a piece of paper to remove the stain using mechanical force.

TABLE 2

| Parameter | Description |
|---|---|
| Washing Water Volume | 60 liters at 15 to 35° C. |
| Wash Load Size | 1.5 Kg |
| Detergent Dosage | 60 grams |
| Fabric Softener Dosage | 66 grams |
| Water Hardness | 100-450 ppm |

Samples were compared without using any fabric conditioner and re to read in the Hunter Lab spectrum each stain in to the different fabric to obtain the coordinate L* to compare both fabrics with the treatments and without to have the differences analyzed statistically.

Example 3

Five stains: oil, barbeque sauce, mustard, coffee and milk-chocolate were evaluated on six types of fabrics. The percentage of stain resistance was calculated using Equation 1, after 0, 5, 10 and 20 washes for each stain and fabric.

$$\% \text{ Stain Resistance} = 100 - \left(\frac{L^*o}{L^*f} \times 100\right) \qquad \text{Equation 1}$$

$f^*o =$ $L^*$ value from fabric without treatment after being stained $L^*f = L^*$ value from fabric with treatment after being stained Results were evaluated by dispersion graphic analysis. A generic fabric softener was used as a reference to determine performance.

As shown in FIG. 1, exemplary compositions of the present invention demonstrate reduction of barbeque stain adherence on nylon/spandex, polyester/spandex, wool and polyester/cotton samples.

Figure 2:
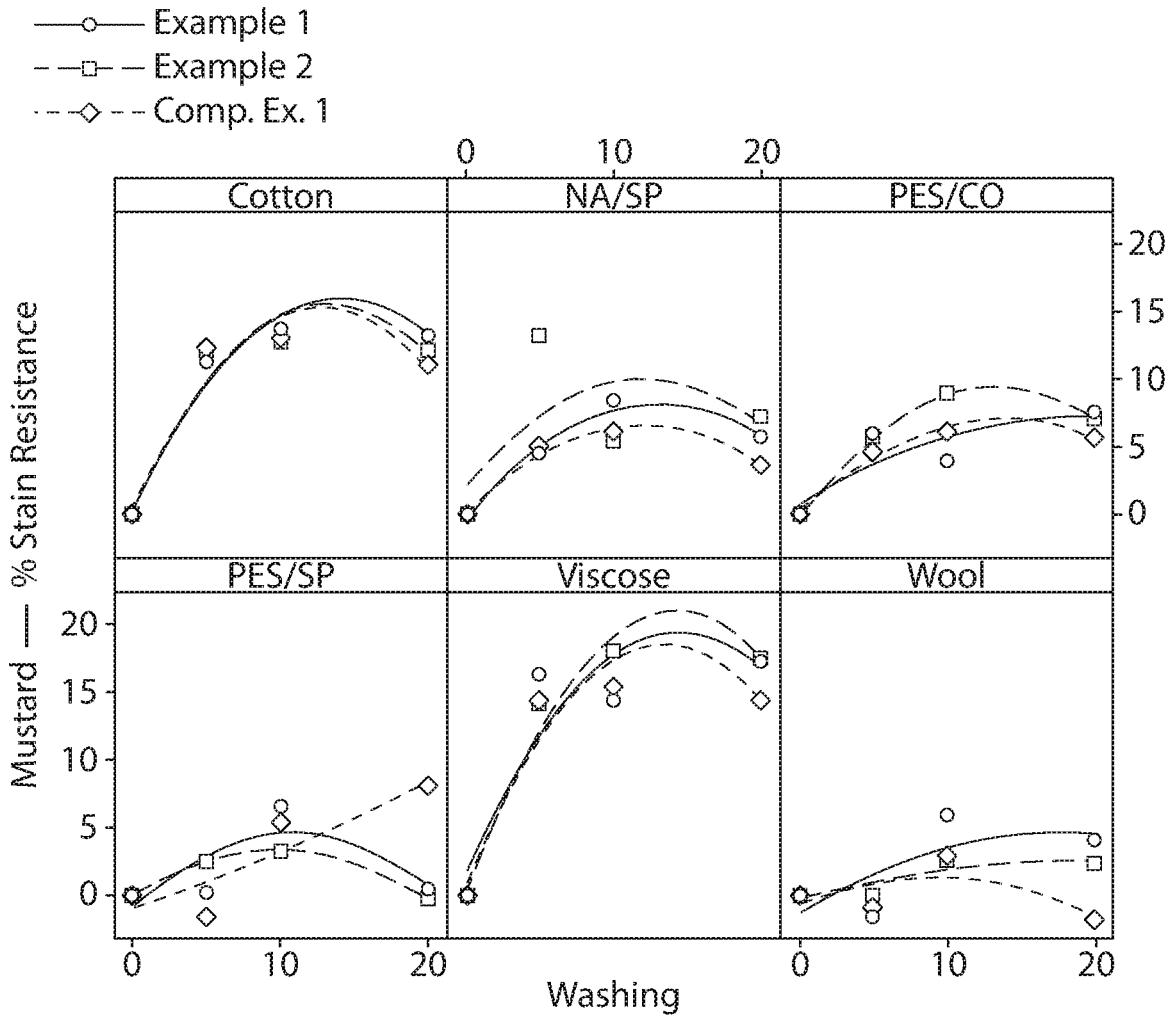
FIG. 2 depicts data generated from exemplary compositions of the present invention, along with various comparative compositions. The data describes—inter alia—the reduction of mustard stain adherence to various fabrics.

As shown in FIG. 2, exemplary compositions of present invention provide reduction of mustard stain adherence on nylon/spandex, wool and polyester/cotton samples.

Figure 3:
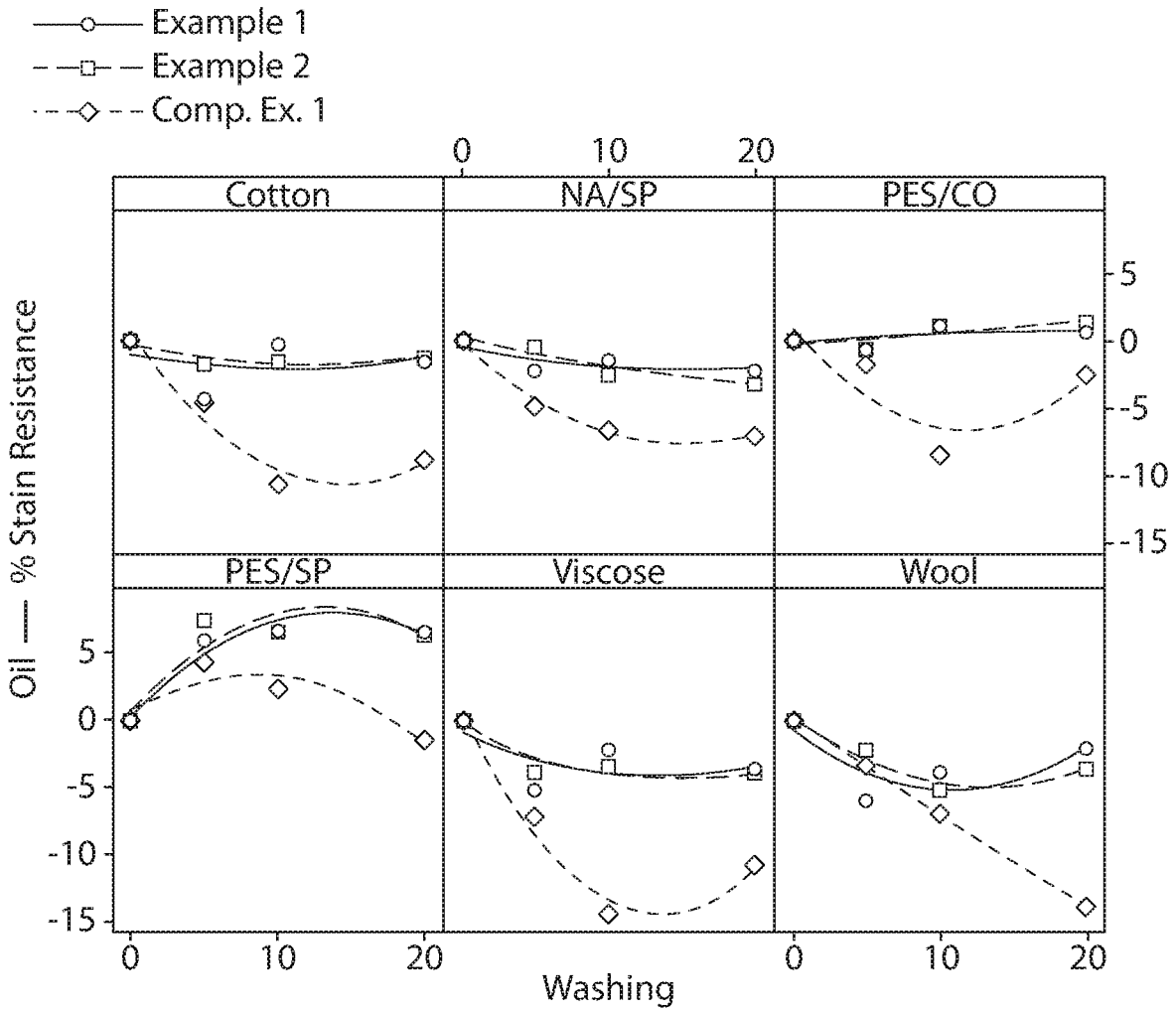
FIG. 3 depicts data generated from exemplary compositions of the present invention, along with various comparative compositions. The data describes—inter alia—the reduction of oil stain adherence to various fabrics.

As shown in FIG. 3, exemplary compositions of the present invention reduce the interaction between oil stains on all six fabric samples and have a protective effect; whereas the comparative compositions promote oil fixation on the same fabrics.

Figure 4:
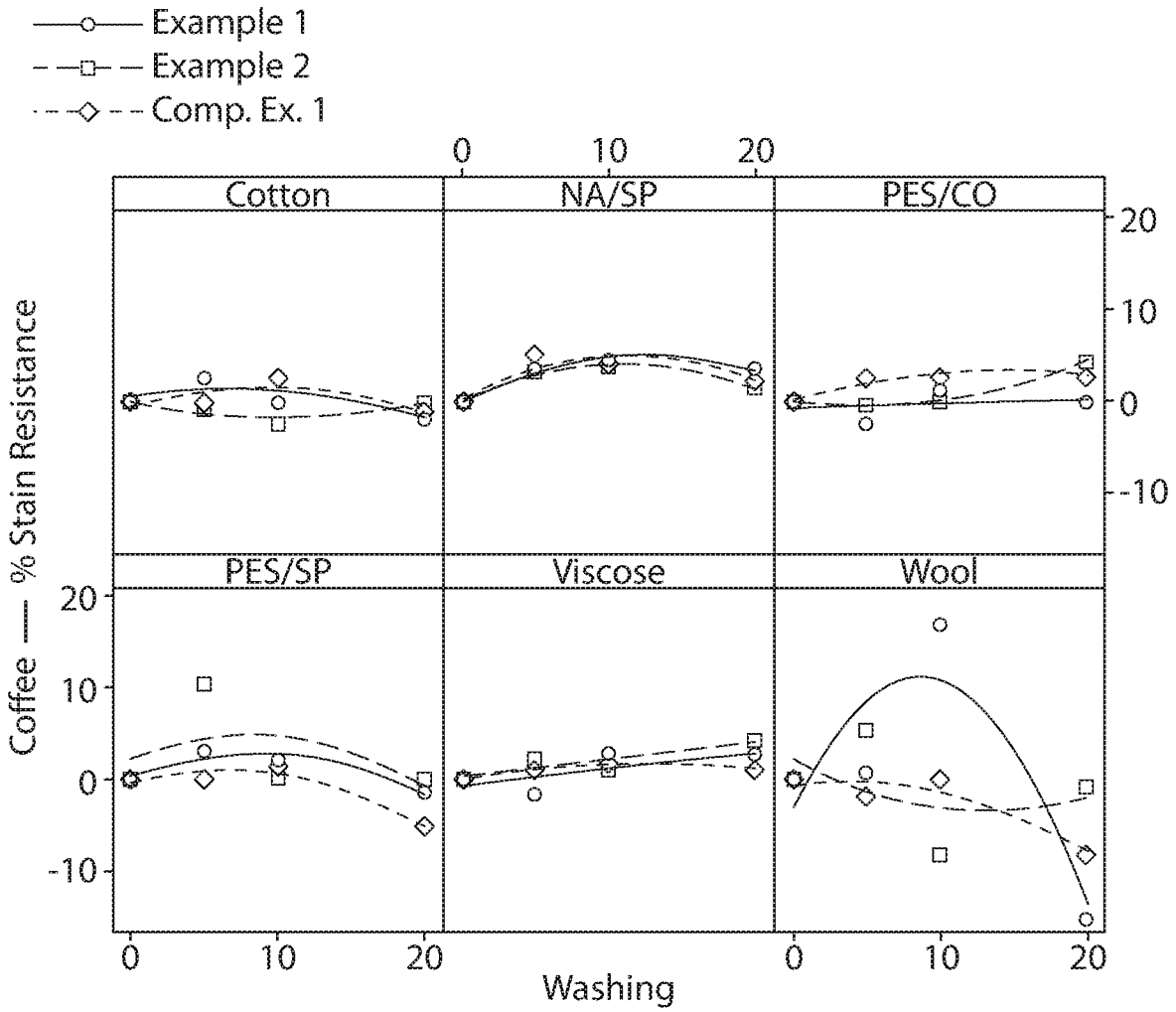
FIG. 4 depicts the data generated from exemplary compositions of the present invention, along with various comparative compositions. The data describes—inter alia—the reduction of coffee stain adherence to various fabrics.
Figure 5:
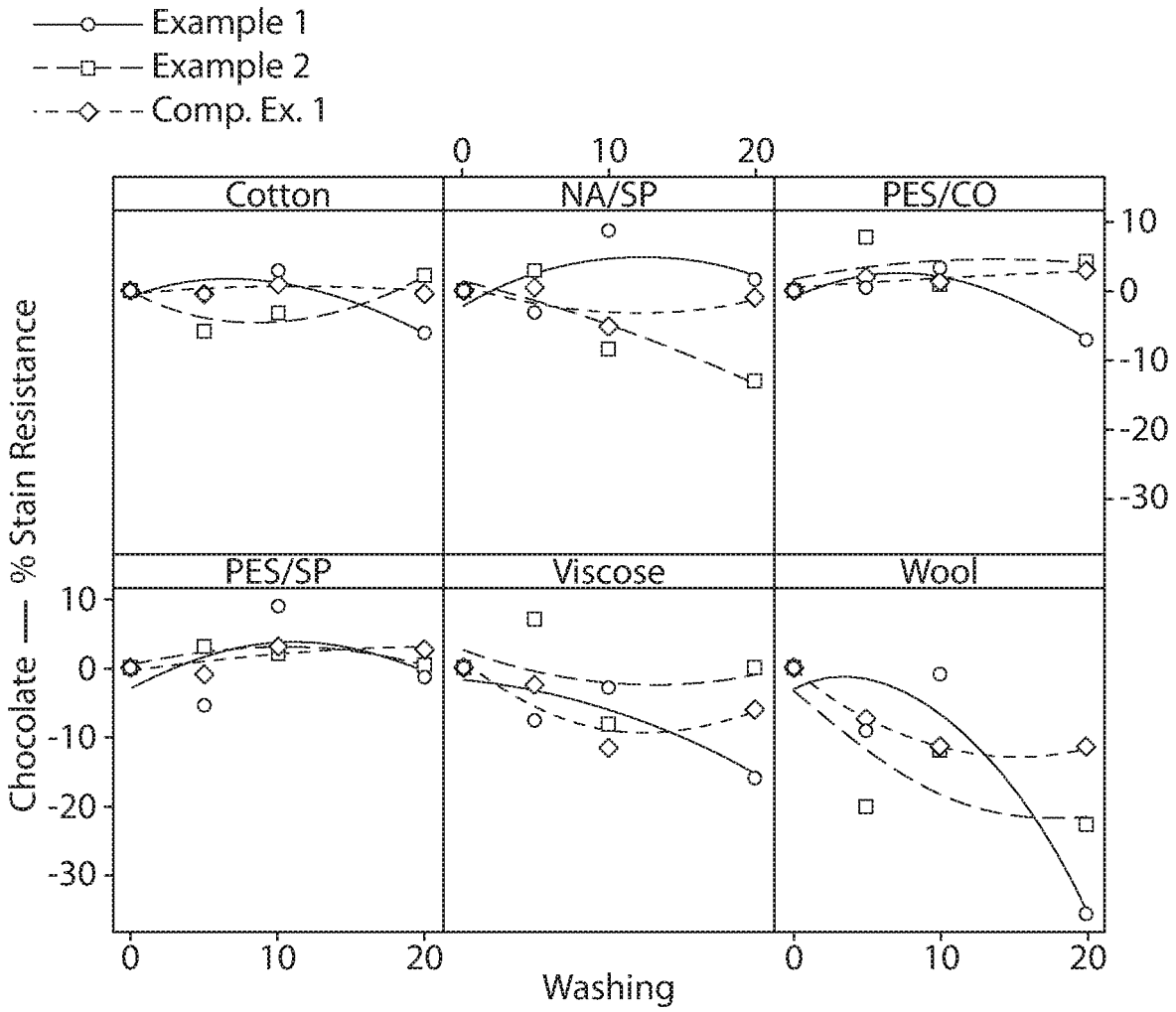
FIG. 5 depicts the data generated from exemplary compositions of the present invention, along with various comparative compositions. The data describes—inter alia—the reduction of chocolate milk stain adherence to various fabrics.

As shown in FIGS. 4 and 5, exemplary compositions of the present invention provide some stain reduction benefit against solid stains (e.g. coffee and chocolate) on certain fabrics.

Example 4

Figure 6:
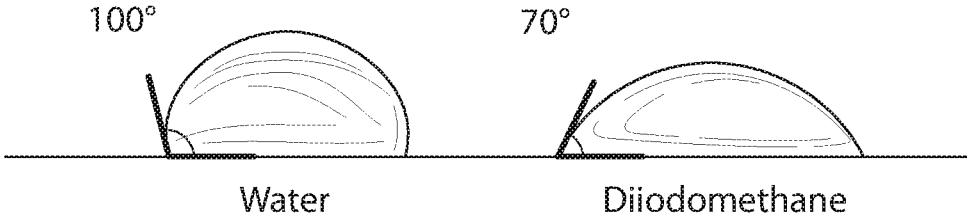
FIG. 6 depicts the hydrophobicity of certain exemplary compositions of the claimed invention.
Figure 7:
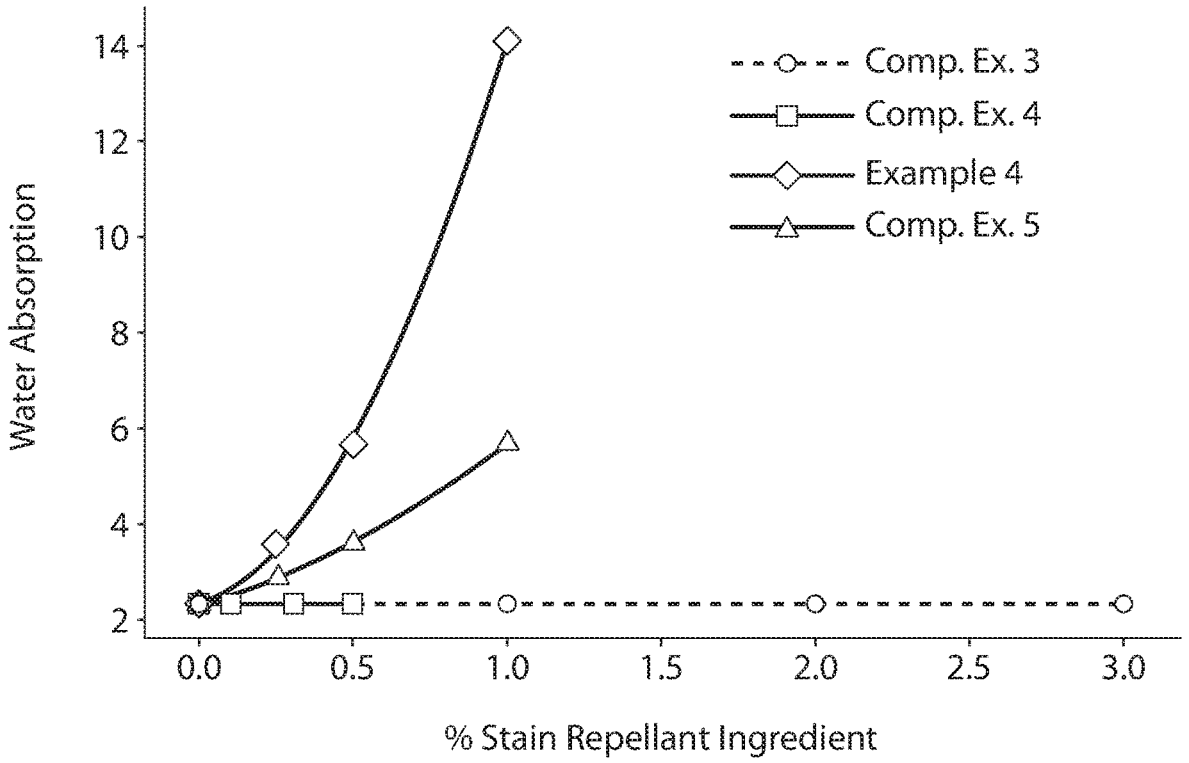
FIG. 7 depicts the results of a water repellency index test comparing certain embodiments of the claimed invention with comparative compositions.

The water-repellent properties of exemplary compositions of the present invention comprising various concentrations of an aminofunctional polysiloxane and comparative compositions comprising various concentrations of a Mercaptoalkylsiloxane alkylaminomethacrylate copolymer are measured. As shown in FIGS. 6 and 7, exemplary compositions of the present invention comprising various concentrations of an aminofunctional polysiloxane demonstrate increased hydrophobicity and water repellency, whereas comparative compositions comprising various concentrations of a Mercaptoalkylsiloxane alkylaminomethacrylate copolymer do not.

Example 5

Several exemplary compositions comprising—in relevant part—various levels of an aminofunctional polysiloxane were prepared, along with several comparative compositions comprising—in relevant part—various levels of a mercaptoalkylsiloxane alkylaminomethacrylate copolymer. The following AATCC 130-2000 methodology was used to evaluate the stain protection benefit: squares of 100% cotton fabric were washed five (5) times with a fabric care composition, then each sample of fabric was stained with milk-chocolate, barbeque sauce and mustard respectively. After drying, stain color was measured by spectrophotometer. The samples of fabric were then washed with detergent and dried. The remaining stain was then measured using the same spectrophotometer. ΔE was calculated from the initial and final color measurements.

Figure 8:
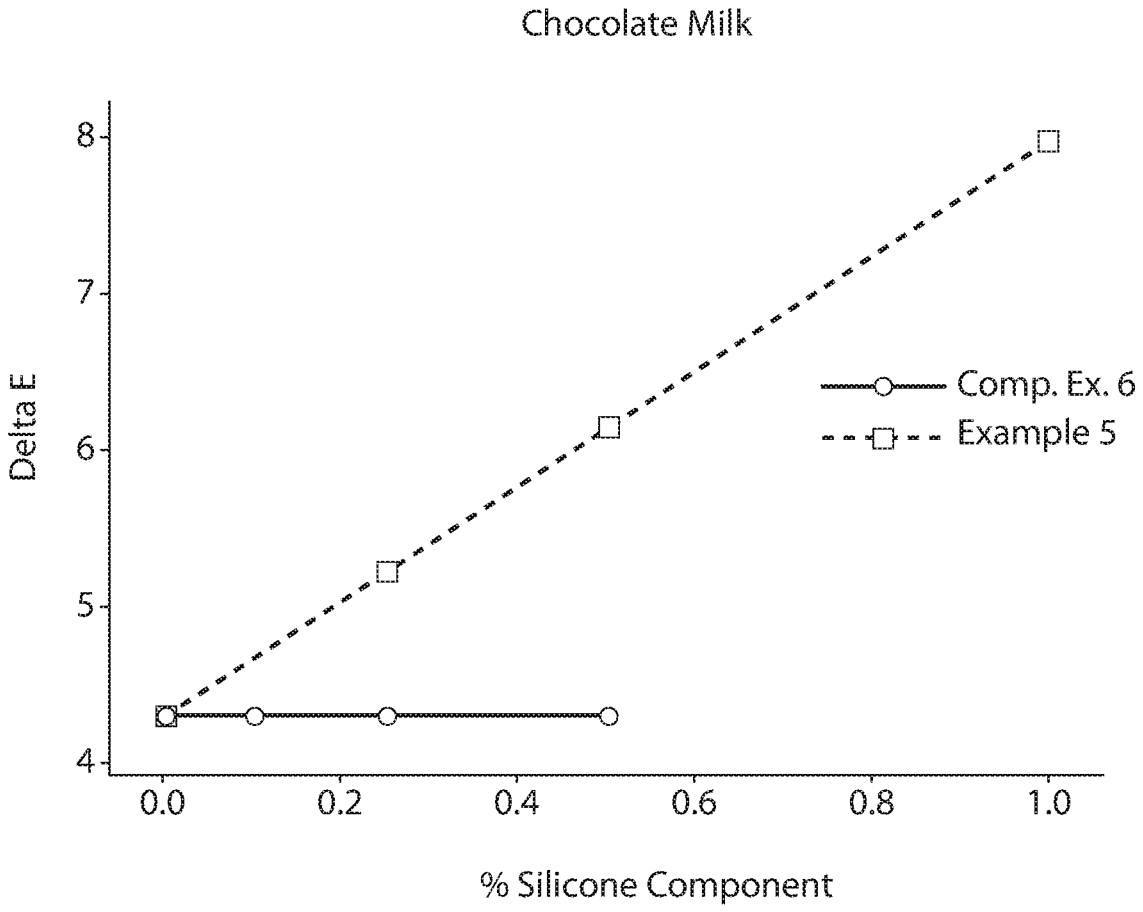
FIG. 8 depicts the results of a stain reduction test using chocolate milk, which compared certain embodiments of the claimed invention with comparative compositions.
Figure 9:
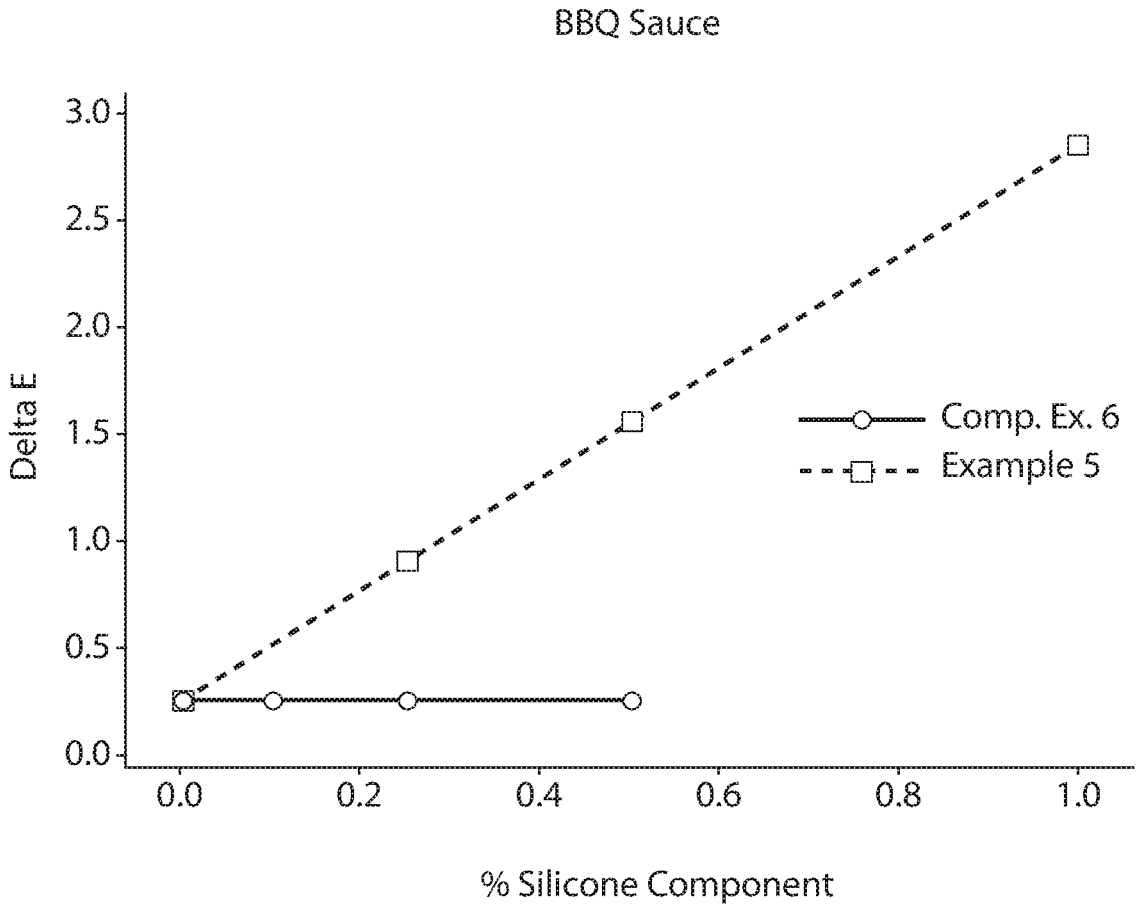
FIG. 9 depicts the results of a stain reduction test using barbeque sauce, which compared certain embodiments of the claimed invention with comparative compositions.
Figure 10:
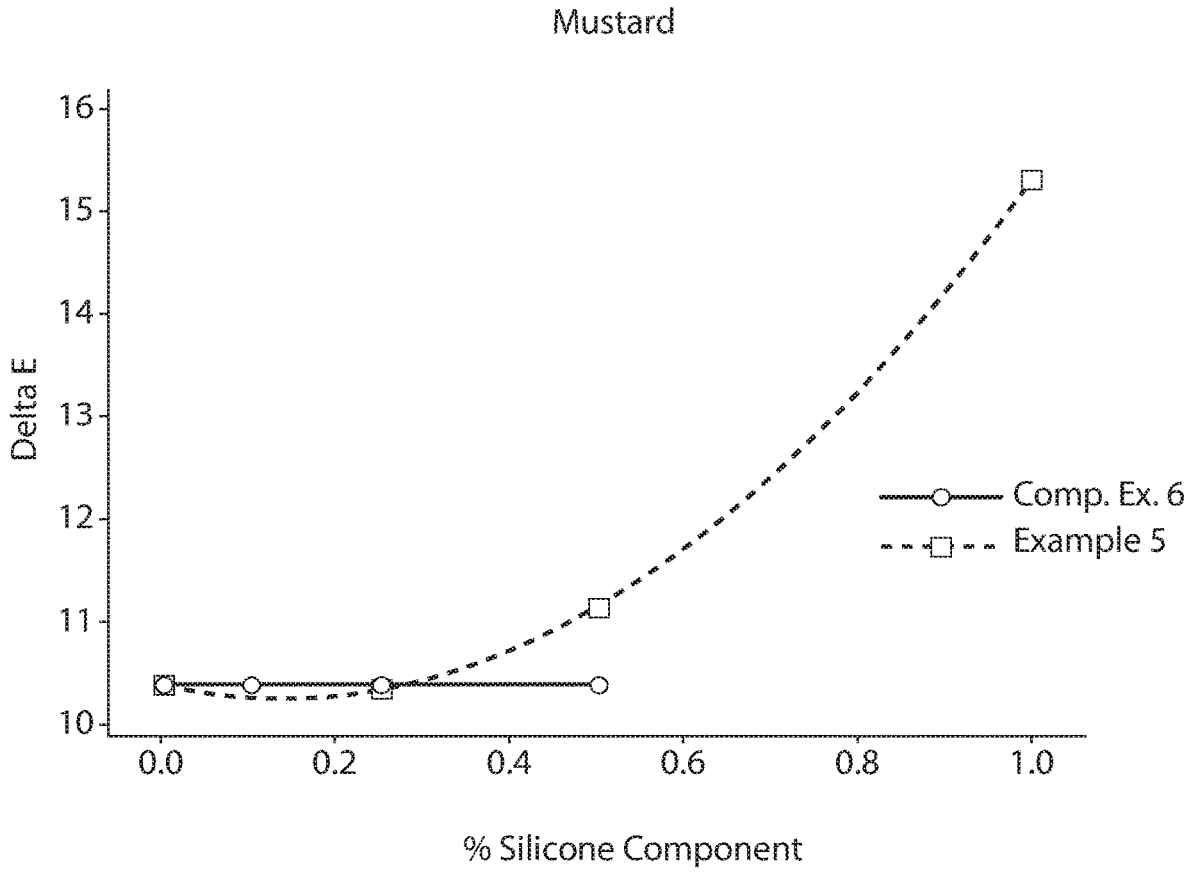
FIG. 10 depicts the results of a stain reduction test using mustard, which compared certain embodiments of the claimed invention with comparative compositions.

As illustrated by FIGS. 8-10, fabric treated with exemplary compositions of the present invention comprising various concentrations of an aminofunctional polysiloxane, unexpectedly demonstrate an ability to resist stains from milk-chocolate, barbeque sauce and mustard.

With regard to mustard stains, the data demonstrates that mustard stains are more easily removed from fabric pretreated with exemplary fabric care compositions of the present invention comprising greater than about 0.2% of aminofunctional polysiloxane. Also shown in FIGS. 8-10, is that fabric care compositions comprising mercaptoalkylsiloxane alkylaminomethacrylate copolymer cannot provide stain protection at any concentration.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A fabric care composition comprising:
an aminofunctional polysiloxane;
a fabric softening active ingredient;
a cationic co-softener;
a thickening agent; and
a non-ionic surfactant;
wherein the non-ionic surfactant comprises $C_{14}$-$C_{15}$ alcohol EO 20:1;
wherein the aminofunctional polysiloxane is present in an amount effective to resist or prevent a stain selected from an oil stain; a mustard stain; a barbeque sauce stain; a chocolate milk stain; and a coffee stain;
wherein the aminofunctional polysiloxane is present in an amount of from about 0.25% to about 0.4%, by weight of the fabric care composition; and
wherein the aminofunctional polysiloxane comprises a compound of Formula (I):

(I)

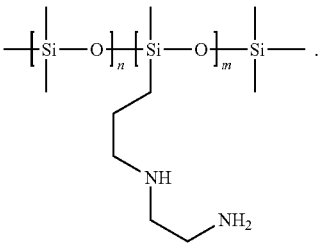

2. The fabric care composition according to claim 1, wherein the aminofunctional polysiloxane is present in an amount of about 0.25%, or about 0.3%, by weight of the fabric care composition.

3. The fabric care composition according to claim 1, wherein the non-ionic surfactant is present in an amount of from about 0.1% to about 0.5%, by weight of the fabric care composition.

4. The fabric care composition according to claim 1, wherein the non-ionic surfactant is present in an amount of from about 0.24%, by weight of the fabric care composition.

5. The fabric care composition according to claim 1, wherein the fabric softening active ingredient is cationic.

6. The fabric care composition according to claim 1, wherein the fabric softening active ingredient comprises an esterquat.

7. The fabric care composition according to claim 1, wherein the thickening agent comprises an acrylate thickening agent.

8. The fabric care composition according to claim 1, wherein the thickening agent is cationic.

9. The fabric care composition according to claim 1, wherein the thickening agent is provided in the form of an emulsion.

10. The fabric care composition according to claim 1, having a viscosity of from about 1 to about 500 cPs.

11. The fabric care composition according to claim 1, further comprising a pH modifying agent.

12. The fabric care composition according to claim 11, wherein the pH modifying agent is present in an amount from about 0.01% to about 0.1%, by weight of the fabric care composition.

13. The fabric care composition according to claim 11, wherein the pH modifying agent comprises citric acid, lactic acid, or a combination thereof.

14. The fabric care composition according to claim 11, wherein the pH modifying agent is present in an amount effective to maintain the pH of the fabric care composition in a range of from about 2.5 to about 4.0.

15. The fabric care composition according to claim 1, comprising
about 0.24% $C_{14}$-$C_{15}$ alcohol EO 20:1,
about 0.3% acrylate thickener,
about 3-4% esterquat,
about 0.33% polyquaternium-7, and
about 0.25%-0.4% aminofunctional polysiloxane of formula (I) by weight of the fabric care composition:

(I)

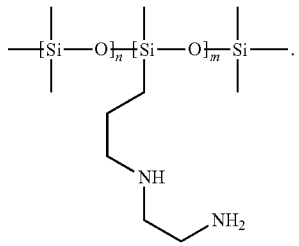

16. The fabric care composition according to claim 15, further comprising:
about 0.0625% lactic acid,
about 0.020% microbicide, and
about 0.08% silicone antifoam 1086, by weight of the fabric care composition.

17. The fabric care composition according to claim 1, wherein the co-softener is present in an amount of from about 0.1% to about 0.5%, by weight of the fabric care composition.

18. A method for resisting, preventing or removing a stain on a fabric selected from an oil stain; a mustard stain; a barbeque stain; a chocolate milk stain; and a coffee stain, comprising: contacting the fabric with a fabric care composition of claim 1.

* * * * *